US010696359B2

(12) United States Patent
Ottolini et al.

(10) Patent No.: US 10,696,359 B2
(45) Date of Patent: Jun. 30, 2020

(54) TURRET ASSEMBLY

(71) Applicant: BLUEWATER ENERGY SERVICES B.V., Hoofddorp (NL)

(72) Inventors: Patrizio Giovanni Matia Ottolini, Voorhout (NL); Bernardus Rudolphus Ignatius Luttmer, Utrecht (NL); Jacob Jan Van Nielen, Heemstede (NL)

(73) Assignee: BLUEWATER ENERGY SERVICES B.V., Hoofddorp (NL)

( * ) Notice: Subject to any disclaimer, the term of this patent is extended or adjusted under 35 U.S.C. 154(b) by 0 days.

(21) Appl. No.: 16/300,280

(22) PCT Filed: May 24, 2016

(86) PCT No.: PCT/EP2016/061666
§ 371 (c)(1),
(2) Date: Nov. 9, 2018

(87) PCT Pub. No.: WO2017/202452
PCT Pub. Date: Nov. 30, 2017

(65) Prior Publication Data

US 2019/0144078 A1 May 16, 2019

(51) Int. Cl.
*B63B 21/50* (2006.01)
*B63B 21/00* (2006.01)

(52) U.S. Cl.
CPC ..... *B63B 21/507* (2013.01); *B63B 21/00* (2013.01); *B63B 2021/003* (2013.01)

(58) Field of Classification Search
CPC .. B63B 21/00; B63B 21/507; B63B 2021/003
See application file for complete search history.

(56) References Cited

U.S. PATENT DOCUMENTS 4,305,341 A 12/1981 Stafford
4,701,143 A 10/1987 Key et al.
(Continued)

FOREIGN PATENT DOCUMENTS

EP 0259072 A1 3/1988
EP 0656293 A1 6/1995
(Continued)

OTHER PUBLICATIONS

International Search Report dated Dec. 21, 2016, for corresponding International Application No. PCT/EP2016/061666, filed May 24, 2016.

(Continued)

*Primary Examiner* — S. Joseph Morano
*Assistant Examiner* — Jovon E Hayes
(74) *Attorney, Agent, or Firm* — Steven M. Koehler; Westman, Champlin & Koehler

(57) ABSTRACT

A turret assembly for a vessel comprises a moonpool defined in the vessel and a turret structure rotatably mounted in said moonpool. The turret structure comprises a turret table which by means of a main bearing is rotatably mounted in said moonpool and a hollow turret shaft defined by a surrounding shaft wall, which turret shaft has an upper shaft end connected to the turret table, a substantially cylindrical shaft part that extends downwardly from the turret table and a lower shaft end provided with means intended for cooperation with a lower bearing. The shaft wall of the upper shaft end comprises a widened part surrounding the cylindrical shaft part and defines a circumferential crest, wherein the shaft wall of the upper shaft end, starting from said circumferential crest, extends downwardly towards a position where the upper shaft end is connected to the turret table.

16 Claims, 3 Drawing Sheets

(56) References Cited

U.S. PATENT DOCUMENTS

| | | | | |
|---|---|---|---|---|
| 4,841,895 | A | 6/1989 | Brewerton | |
| 4,955,310 | A | 9/1990 | Pollack | |
| 5,065,689 | A | 11/1991 | Krogstad | |
| 5,178,087 | A | 1/1993 | O'nion et al. | |
| 5,381,750 | A | 1/1995 | Pollack | |
| 5,893,784 | A | 4/1999 | Boatman | |
| 6,698,372 | B2 | 3/2004 | Hobdy et al. | |
| 6,708,639 | B2 | 3/2004 | Cottrell et al. | |
| 7,225,749 | B2 | 6/2007 | Boatman | |
| 9,108,702 | B2 | 8/2015 | Ottolini | |
| 2002/0073906 | A1 | 6/2002 | Hobdy et al. | |
| 2003/0121465 | A1* | 7/2003 | Boatman | B63B 21/507 114/230.12 |
| 2004/0261683 | A1 | 12/2004 | Lindblade et al. | |
| 2005/0061224 | A1 | 3/2005 | Boatman | |
| 2014/0216322 | A1 | 8/2014 | Ottolini | |
| 2016/0137267 | A1* | 5/2016 | Hooper | B63B 21/50 114/200 |
| 2019/0144078 | A1* | 5/2019 | Ottolini | B63B 21/00 114/230.12 |

FOREIGN PATENT DOCUMENTS

| | | | |
|---|---|---|---|
| WO | 8706555 | A1 | 11/1987 |
| WO | 8903338 | A1 | 4/1989 |
| WO | 0232753 | A1 | 4/2002 |
| WO | 2012163394 | A1 | 12/2012 |

OTHER PUBLICATIONS

Written Opinion of the International Searching Authority dated Dec. 21, 2016, for corresponding International Application No. PCT/EP2016/061666, filed May 24, 2016.

* cited by examiner

Fig.1b
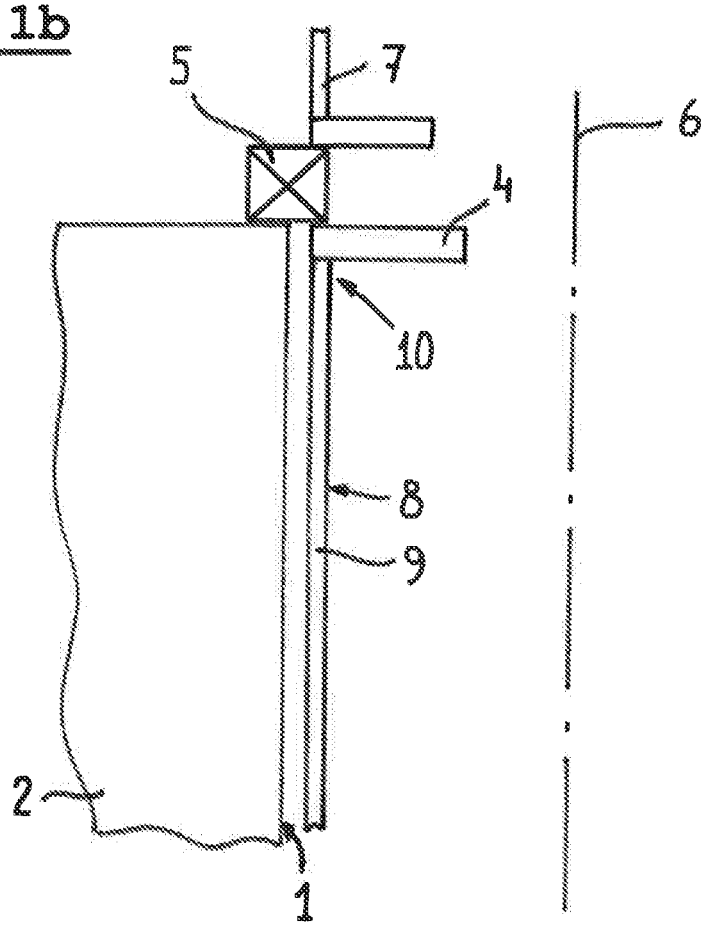
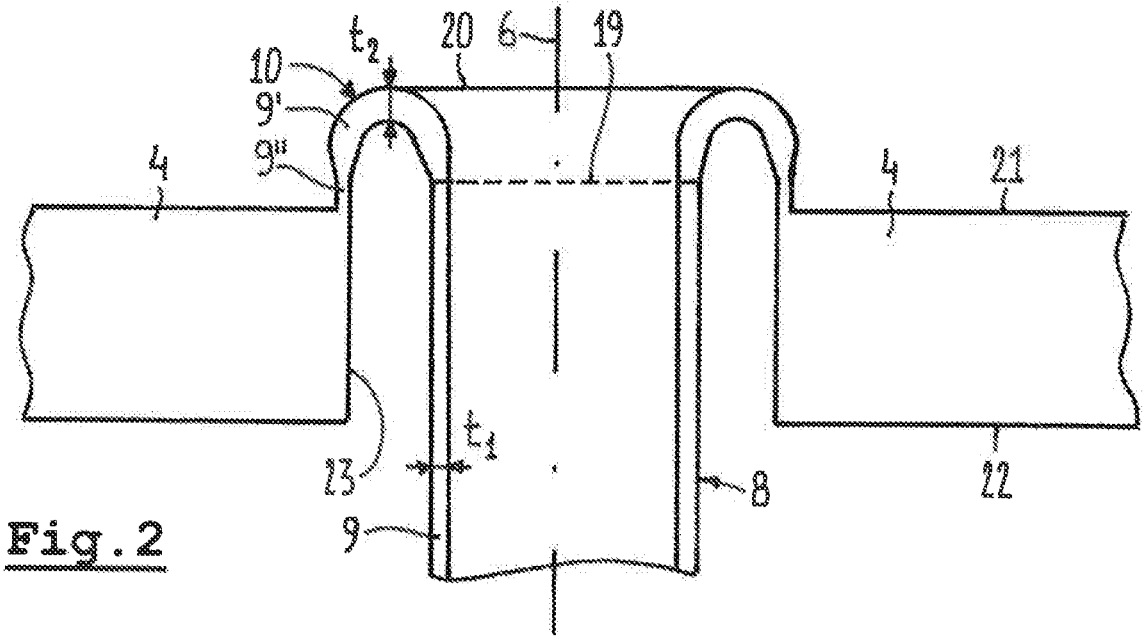
Fig.2

TURRET ASSEMBLY

CROSS-REFERENCE TO RELATED APPLICATION

The present application is a national stage of International patent application Serial No. PCT/EP2016/061666, filed May 24, 2016, and published in English as WO/2017/202452.

BACKGROUND

Aspects of the invention relate to a turret assembly for a vessel, comprising a moonpool defined in the vessel and a turret structure rotatably mounted in said moonpool, wherein the turret structure comprises a turret table which by means of a main bearing is rotatably mounted in said moonpool and a hollow turret shaft defined by a surrounding shaft wall, which turret shaft has an upper shaft end connected to the turret table, a substantially cylindrical shaft part that extends downwardly from the turret table and a lower shaft end provided with lower means intended for cooperation with a lower bearing.

Such a turret assembly allows a vessel to weathervane around the turret structure which at its lower end (typically at the lower end of the vessel section, possibly near the elevation of the keel of the vessel) is provided with lower means (such as a chain table or for example a detachable buoy) for mooring purposes and/or for supporting risers and umbilicals for, for example, transfer of gas, fluids, power and signals. The main bearing defines the connection between the moonpool (vessel) and the turret structure (turret table) and its function is predominantly to transfer mooring, riser and inertia loads from the turret into the vessel while allowing weathervaning of the vessel. The turret table may support a turntable or process manifold, as is generally known for such a turret assembly.

The functions of the lower bearing are among others to limit the horizontal force on the main bearing and the bending moment in the shaft. The lower bearing generally and purposely transfers forces in a horizontal direction. The lower bearing may be a sliding bearing type with an initial gap (also known as "clearance" or "play") of a few millimetres, amongst others to allow the vessel to deform ("sagging" and "hogging") without "pinching" or without excessive "pinching" of the turret. The clearance can also occur over lifetime due to wear of the lower bearing components.

The clearance decouples the chain table from the vessel and therefore any horizontal loads on the chain table travel up the turret shaft to the main bearing. This causes bending moments in the turret shaft and additional loads on the main bearing, both of which could be substantial. These effects are largely limited by the closing of the lower bearing which occurs when the turret shaft has sufficiently bent so that the chain table closes the gap with the vessel. Further increase of the horizontal load will substantially be transferred from the chain table into the vessel trough the lower bearing.

There are a number of options for promoting the closure of the lower bearing and to reduce free motions within given play, such as for example decreasing the size of the lower bearing gap, adopting an alternative design for the lower bearing, pre-compressing the chain table against the vessel during the installation of the turret (for removing initial free play) and the use of structural elements with a smaller Young's modulus than steel (for example rubber).

SUMMARY

An aspect of the present invention provides an improved turret assembly in which the flexibility of the turret shaft is increased such that it bends more easily and thus more easily closes the lower bearing limiting excessive loads in the turret shaft or in the main bearing.

The turret assembly of the present disclosure has a shaft wall of an upper shaft end comprising a widened part surrounding a cylindrical shaft part and defining a circumferential crest, wherein the shaft wall of the upper shaft end, starting from said circumferential crest, extends downwardly towards a position where the upper shaft end is connected to a turret table.

The disclosed assembly offers a way to increase the effective length and therefore the flexibility of the turret shaft. As a result of such an increased effective length and flexibility the lower bearing already closes under smaller loads.

The disclosed assembly may be embodied in a number of embodiments. Thus, in one embodiment the shaft wall of the upper shaft end substantially defines a half torus shape.

In another embodiment the shaft wall of the upper shaft part end substantially defines a revolved elliptical shape. This means that, as seen in a cross section of the upper shaft part, said wall defines at least part of an ellipse.

In one embodiment at least a part of the shaft wall between the circumferential crest and the turret table extends vertically for defining a substantially elongate cylindrical shaft wall part. This yields a constructively simple, yet effective design.

As an alternative at least a part of the shaft wall between the circumferential crest and the turret table extends inclined outwardly for defining a widening shaft wall part or extends inclined inwardly for defining a narrowing shaft wall part.

In another embodiment the shaft wall, starting from the connection between the cylindrical shaft part and the upper shaft end extends horizontally for defining a ring-shaped circumferential crest. In such an embodiment the upper shaft end has a flat crest and also may define a square or rectangular cross section.

In such an embodiment it further is possible that at said ring-shaped circumferential crest a torsion-box like construction or a solid block is provided. This provides additional means for influencing the properties and behaviour of the turret shaft.

In yet another embodiment the turret table comprises an upper surface and a lower surface, wherein a channel is provided extending between said upper and lower surfaces, through which channel the turret shaft extends (without its cylindrical shaft part touching the turret table) and wherein the circumferential crest of the upper shaft end is located at a level above said upper surface of the turret table. As an alternative, however, it is conceivable that the turret table comprises an upper surface and a lower surface, wherein a recess is provided extending upwardly from the lower surface in which the upper shaft end is located and wherein the circumferential crest of the upper shaft end is located at a level between said upper surface and said lower surface. In the latter case it further is possible that said recess has a closed upper end below the upper surface, as a result of which the upper surface of the turret table may be carried out without any interrupting opening.

Further it is conceivable that at least part of the shaft wall of the upper shaft end may have a larger thickness than remaining parts of the shaft wall. Such a feature also may be used for determining the behavior of the turret shaft, especially of the upper shaft end.

In such an embodiment a transition between shaft wall parts with different thicknesses may be symmetrical (equally at both sides of the wall) or asymmetrical (differently at both sides or only at one side of the wall).

The means provided at the lower shaft end and intended for cooperation with a lower bearing may define a chain table intended for supporting, among others, anchoring or mooring lines. It also may support risers and umbilicals.

In general the turret shaft is more flexible than current designs because the (effective) length of the turret shaft is extended. Considering that the sideward stiffness of the turret depends on the turret shaft length cubed and that the additional turret shaft length is significant with respect to state of the art design lengths, the gain in flexibility of the turret shaft is large.

The design provides the attachment of said upper shaft end to the turret table with additional flexibility. For example a horizontal load at the lower means (such as chain table) will rotate the initially horizontal plane of the upper end at the circumferential crest towards an inclined position. Thus the turret shaft will "start under angle". Even if this angle is small, it has a significant effect on the horizontal displacement of the lower means (e.g. chain table), and thus on the flexibility of the turret shaft, because of the length of the turret shaft.

BRIEF DESCRIPTION OF THE DRAWINGS

Hereinafter aspects of the invention will be elucidated while referring to the drawings, in which:

FIG. 1*b* in a schematic manner illustrates a cross sectional view of another state of the art turret assembly;

FIG. 2 in a schematic manner illustrates a cross sectional view of part of a first embodiment of the turret assembly.

DETAILED DESCRIPTION

Figure 1A:
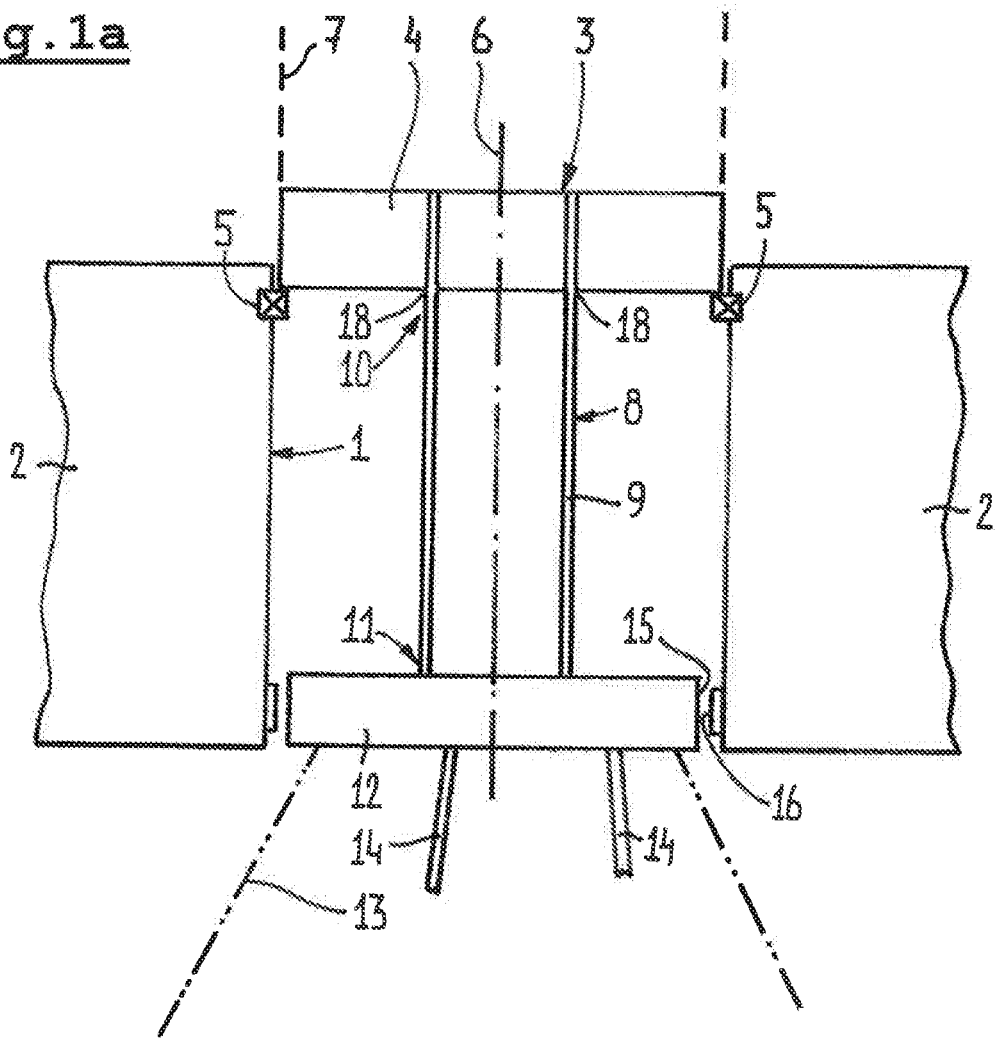
FIG. 1*a* in a schematic manner illustrates a cross sectional view of a state of the art turret assembly.

A state of the art turret assembly for a vessel is schematically represented in FIG. 1*a*. It comprises a moonpool 1 defined in the vessel 2 and a turret structure 3 rotatably mounted in said moonpool 1. The turret structure 3 comprises a turret table 4 which by means of an upper main bearing 5 is rotatably mounted in said moonpool 1 around a vertical axis 6 (such that the vessel 2 can weathervane around the turret structure 3). The turret table 4 also may be part of a so-called turntable, or such a turntable (schematically indicated in broken lines as 7) may be positioned on top of the turret table 4.

The turret structure 3 further comprises a hollow turret shaft 8 defined by a surrounding shaft wall 9. An upper shaft end 10 of the turret shaft 8 is connected to the turret table 4 and a substantially cylindrical shaft part extends downwardly from the turret table 4.

It is noted that the cylindrical shaft part not necessarily should have a circular cross-section, but that also other cross sectional shapes (for example hexagonal or otherwise polygonal) are conceivable. The cylindrical shaft may be conical, at one or more sections or as a whole and may include a variation of diameters and thicknesses over its length.

A lower shaft end 11 is provided with a chain table 12 intended for supporting, among others, anchoring lines or chains 13 and risers 14. The chain table 12 has an outer circumferential surface 15 which is intended for cooperation with a lower bearing 16 positioned on or incorporated into an inner surface 17 of the moonpool 1. It is also known per se that the lower bearing 16 may be fitted to the moonpool 1 and the chain table 12 or parts on the moonpool 1 and other parts on the chain table 12 with mentioned gap in between.

As is generally known, the circumferential surface 15 of the chain table 12 and the lower bearing 16 are spaced by a small gap (the lower bearing is "open") when there are no or only small horizontal loads acting on the chain table 12. However, when such horizontal loads occur (for example arising from mooring loads acting on the anchoring lines 13), the turret shaft 8 will bend until a substantial part of the circumferential surface 15 engages the lower bearing 16 (the lower bearing is "closed").

One will understand that once the circumferential surface 15 engages the moonpool 1 through the lower bearing 16, loads on the turret shaft 8 (especially moments acting at the upper shaft end 10) and main bearing 5 are lowered. Thus it is a primary goal of the present invention to amend the design of the turret assembly in such a manner that the turret shaft 8 can more easily assume a position in which the lower bearing is closed without the need for large horizontal loads acting on the chain table 12 (and thus without resulting large stresses (moments) at the upper shaft end 10 and loads in the main bearing 5).

FIG. 1*b* shows a partial cross sectional view of another state of the art turret assembly. In this layout the turret table 4 is reduced to a flange that connects the upper shaft end 10 to the main bearing 5. Similar parts have identical references as in FIG. 1*a*.

FIG. 2 schematically shows part of an embodiment of the turret assembly. It only represents part of the turret table 4 and of the turret shaft 8 with its upper shaft end 10. The shaft wall 9' of the upper shaft end 10 comprises a widened part surrounding the cylindrical shaft part of the turret shaft 8. This widened part defines a circumferential crest 20. The shaft wall 9' of the upper shaft end 10, starting from said circumferential crest 20, extends downwardly towards a position where the upper shaft end 10 is connected to the turret table 4. In this embodiment the connection between the cylindrical shaft part of the turret shaft 8 and the upper shaft end 10 is indicated schematically by a broken line 19. In the illustrated embodiment the shaft wall 9' of the upper shaft end 10 substantially defines a "half torus shape". The inner dimensions may be such that a person may gain access.

Further one can see that a lower part of the shaft wall 9' between the circumferential crest 20 and the turret table 4 extends vertically for defining a substantially elongate cylindrical shaft wall part 9". This is not necessary, however, in all embodiments and may depend on the specific circumstances (as will hold true for many of the design details described).

FIG. 2 also shows that in this embodiment at least part of the shaft wall 9' of the upper shaft end 10 may have a larger thickness t2 than remaining parts of the shaft wall 9, 9" (which for example have a thickness $t_1$). The transitions between shaft wall parts with different thicknesses may be symmetrical (such as between wall parts 9' and 9") or asymmetrical (such as between wall parts 9' and 9).

The turret table 4 comprises an upper surface 21 and a lower surface 22 and a channel 23 is provided extending between said upper and lower surfaces, through which channel 23 the turret shaft 8 extends without engaging the turret table 4. The circumferential crest 20 of the upper shaft end 10 is located at a level above said upper surface 21 of the turret table 4.

The shape and position of the upper shaft end 10 may be varied in many ways. Some exemplary embodiments are illustrated in FIGS. 3-8 which all show only about one half of a cross sectional view compared to FIG. 2.

Figure 3:
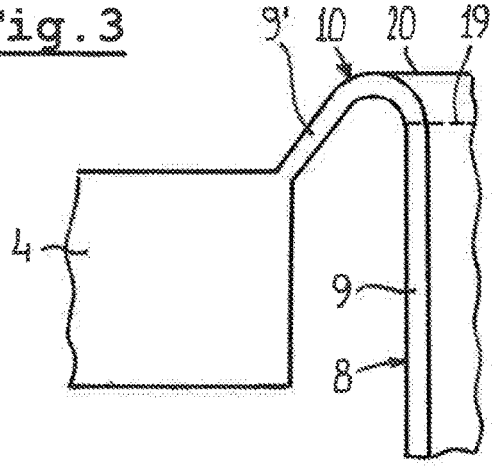
FIGS. 3-8 in a schematic manner show cross sectional views of parts of alternative embodiments of the turret assembly.

In the embodiment illustrated in FIG. 3 a part of the shaft wall 9' between the circumferential crest 20 and the turret table 4 extends inclined outwardly for defining a widening shaft wall part.

Figure 4:
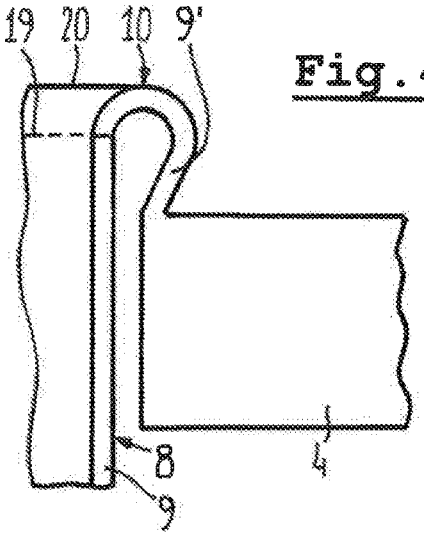

In the embodiment illustrated in FIG. 4 a part of the shaft wall 9' between the circumferential crest 20 and the turret table 4 extends inclined inwardly for defining a narrowing shaft wall part.

Figure 5:
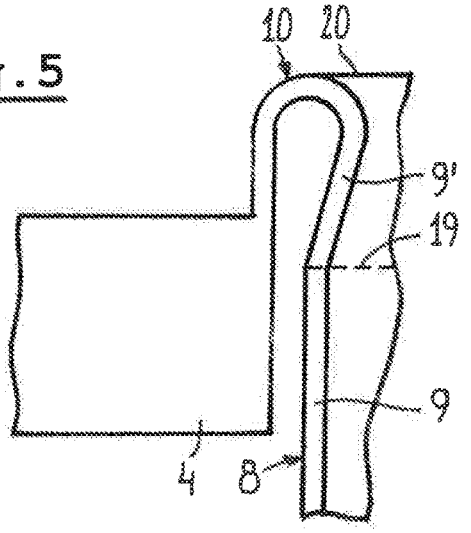

In FIG. 5 a part of the shaft wall 9' of the upper shaft end 10 connecting to the wall 9 of the cylindrical shaft part of the turret shaft 8 extends inclined outwardly (but also may have another orientation).

It is noted that, although in the FIGS. 2-5 the upper shaft end 10 defines part of a torus with a constant radius (as seen in cross section), it also may have different radiuses varying locally or other shapes (for example conical).

Figure 6:
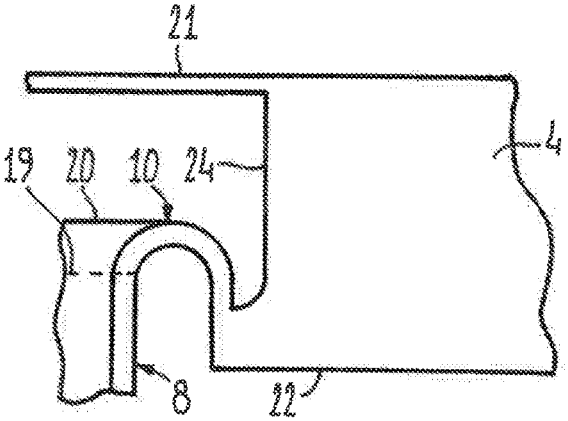

In the embodiment of the turret assembly according to FIG. 6 the turret table 4 comprises an upper surface 21 and a lower surface 22, wherein a recess 24 is provided extending upwardly from the lower surface 22 and having a closed upper end below the upper surface 21. The upper shaft end 10 is located in said recess 24. In this embodiment the circumferential crest 20 of the upper shaft end 10 is located at a level between said upper surface 21 and said lower surface 22. The upper surface 21 in such an embodiment may (or may not) extend uninterrupted over the entire extent of the turret table 4 (apart from any holes or recesses for other purposes).

Figure 7:
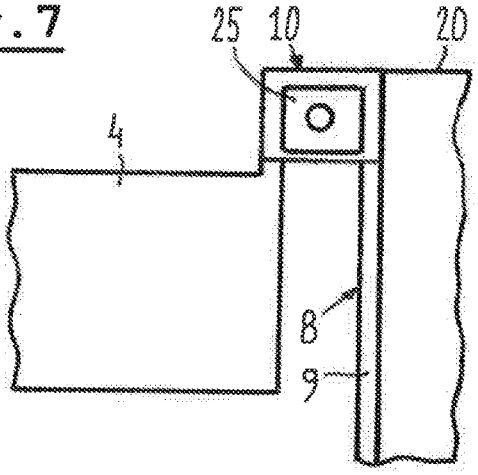
Figure 8:
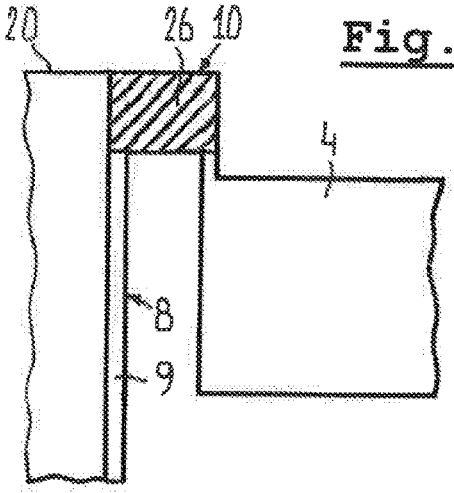

The FIGS. 7 and 8 illustrate embodiments in which the upper shaft end 10 does not define a "half torus" shape (which is defined by a line shaped upper crest 20 as in the FIGS. 2-6) but a square or rectangular shaped design. In these embodiments a planar ring-shaped circumferential crest 20 is defined. Such a design also may be combined with other positions and shapes of some parts of the shaft wall (for example with inclined wall parts as illustrated in FIGS. 3-5). The planar crest 20 also may have an inclined position.

In FIG. 7 at said ring-shaped circumferential crest 20 a torsion-box like construction 25 is provided, whereas in FIG. 8 at said ring-shaped circumferential crest 20 a solid block 26 is provided, whatever suits best constructional demands.

In FIG. 7 the upper wall of the torsion-box like construction also could be made of a part of the shaft wall extending horizontally. In FIG. 8 such a separate horizontally extending shaft wall is not really present, but may be considered to be integrated in the solid block 26. In another embodiment not illustrated, though, the solid block 26 could be located below such a shaft wall.

The invention is not limited to the embodiments described before which may be varied widely within the scope of the invention as defined by the appending claims.

The invention claimed is:

1. A turret assembly for a vessel, comprising a moonpool and a turret structure rotatably mounted in said moonpool, wherein the turret structure comprises a turret table rotatably mounted in said moonpool with a main bearing and a hollow turret shaft defined by a surrounding shaft wall, which turret shaft has an upper shaft end connected to the turret table, a substantially cylindrical shaft part that extends downwardly from the turret table and a lower shaft end cooperating with a lower bearing, wherein the shaft wall of the upper shaft end comprises a widened part surrounding the cylindrical shaft part and defines a circumferential crest, wherein the shaft wall of the upper shaft end, starting from said circumferential crest, extends downwardly towards a position where the upper shaft end is connected to the turret table.

2. The turret assembly according to claim 1, wherein the shaft wall of the upper shaft end substantially defines a half torus shape.

3. The turret assembly according to claim 1, wherein the shaft wall of the upper shaft end substantially defines a revolved elliptical shape.

4. The turret assembly according to claim 1, wherein at least a part of the shaft wall between the circumferential crest and the turret table extends vertically for defining a substantially elongate cylindrical shaft wall part.

5. The turret assembly according to claim 1, wherein at least a part of the shaft wall between the circumferential crest and the turret table extends inclined outwardly for defining a widening shaft wall part.

6. The turret assembly according to claim 1, wherein at least a part of the shaft wall between the circumferential crest and the turret table extends inclined inwardly for defining a narrowing shaft wall part.

7. The turret assembly according to claim 1, wherein the shaft wall, starting from the connection between the cylindrical shaft part and the upper shaft end extends horizontally for defining a ring-shaped circumferential crest.

8. The turret assembly according to claim 7, wherein at said ring-shaped circumferential crest a torsion-box construction is provided.

9. The turret assembly according to claim 7, wherein at said ring-shaped circumferential crest a solid block is provided.

10. The turret assembly according to claim 1, wherein the turret table comprises an upper surface and a lower surface, wherein a channel is provided extending between said upper and lower surfaces, through which channel the turret shaft extends and wherein the circumferential crest of the upper shaft end is located at a level above said upper surface of the turret table.

11. The turret assembly according to claim 1, wherein the turret table comprises an upper surface and a lower surface, wherein a recess is provided extending upwardly from the lower surface in which the upper shaft end is located and wherein the circumferential crest of the upper shaft end is located at a level between said upper surface and said lower surface.

12. The turret assembly according to claim 11, wherein said recess has a closed upper end below the upper surface.

13. The turret assembly according to claim 1, wherein at least part of the shaft wall of the upper shaft end has a larger thickness than remaining parts of the shaft wall.

14. The turret assembly according to claim 13, wherein a transition between shaft wall parts with different thicknesses is asymmetrical.

15. The turret assembly according to claim 13, wherein the lower shaft end includes a lower table cooperating with the lower bearing.

16. The turret assembly according to claim 13, wherein a transition between shaft wall parts with different thicknesses is symmetrical.

* * * * *